United States Patent [19]

Pauley

[11] Patent Number: 4,936,452

[45] Date of Patent: Jun. 26, 1990

[54] BATHROOM TISSUE CONTAINER

[76] Inventor: Helena R. Pauley, Rte. 1, Box 416A, Ashland City, Tenn. 37015

[21] Appl. No.: 362,006

[22] Filed: Jun. 5, 1989

[51] Int. Cl.[5] ..... B65D 85/67

[52] U.S. Cl. ..... 206/390; 206/408; 206/409; 206/416; 242/55.53

[58] Field of Search ..... 206/408, 413, 414, 415, 206/416, 409, 446, 390; 221/63, 307; 242/55.2, 55.53, 55.54; 248/905

[56] References Cited

U.S. PATENT DOCUMENTS

| | | | |
|---|---|---|---|
| 20,333 | 4/1937 | Perrin | 242/55.53 |
| 527,644 | 10/1894 | Akers | 206/409 |
| 823,318 | 6/1906 | Brown | 242/55.2 |
| 943,279 | 12/1909 | Smith | 242/55.53 |
| 1,013,715 | 1/1912 | Yuste et al. | 206/409 |
| 1,097,385 | 5/1914 | Barns | 242/55.53 |
| 1,107,747 | 8/1914 | Bauer | 242/55.53 |
| 1,540,876 | 6/1925 | Dwyer | 242/55.53 |
| 1,910,094 | 5/1933 | Crane et al. | 206/806 |
| 2,287,581 | 6/1942 | Walker | 248/905 |
| 2,331,675 | 10/1943 | Frost | 242/55.53 |
| 2,678,777 | 5/1954 | Donkin | 242/55.53 |
| 3,151,793 | 10/1964 | Smith | 248/905 |
| 3,307,774 | 3/1967 | Fant | 248/905 |
| 3,472,364 | 10/1969 | Sloan | 242/55.53 |
| 3,525,462 | 8/1970 | Freedman | 242/55.2 |
| 3,667,596 | 6/1972 | Lucas et al. | 206/449 |
| 4,069,958 | 1/1978 | Strauss | 242/55.53 |
| 4,093,138 | 6/1978 | Shafer | 242/55.2 |
| 4,615,442 | 10/1986 | Beeken | 206/408 |
| 4,738,385 | 4/1988 | Bell | 242/55.54 |

FOREIGN PATENT DOCUMENTS

| | | | |
|---|---|---|---|
| 2027808 | 12/1971 | Fed. Rep. of Germany | 242/55.54 |
| 0587604 | 1/1959 | Italy | 242/55.53 |
| 0193107 | 2/1960 | Sweden | 242/55.53 |
| 0003608 | 2/1984 | United Kingdom | 242/55.53 |

*Primary Examiner*—Paul T. Sewell
*Assistant Examiner*—Jacob K. Ackun, Jr.
*Attorney, Agent, or Firm*—Leon Gilden

[57] ABSTRACT

A bathroom tissue container is set forth wherein an elongate tubular support member includes an elongate slot therein with a threaded cap securably mounted to the support member overlying the slot. The slot includes a fixed serrated clamp and a movably mounted serrated clamp to either side of the slot to maintain tissue removed from within the container and prevent such tissue from withdrawal into the container. The movable serrated clamp includes a spring-biased cylindrical guide movably mounted relative to an interior wall of the container adjacent the slot to maintain a smooth presentation of tissue for removal. The threaded closure includes an interior portion of resilient cushion with a smooth polymeric abutment disk to maintain the tissue in alignment with the container and resiliently bias a roll of tissue within the container during use.

6 Claims, 4 Drawing Sheets

BATHROOM TISSUE CONTAINER

BACKGROUND OF THE INVENTION

1. Field of the Invention

The field of invention relates to tissue containers, and more particularly pertains to a new and improved tissue container for dispensing of bathroom tissue and convenient storage thereof.

2. Description of the Prior Art

The use of various storage containers of tissue is well known in the prior art. Heretofore, however, containers have been of size and proportion to minimize their convenience when sanitary dispensing of tissue is desired by an individual. For example, U.S. Pat. No. 1,910,094 to Crane sets forth a paper dispensing package to secure an interfolded stack of paper therein with a pivoted flap overlying a removal slot.

U.S. Pat. No. 2,287,581 to Walker sets forth a tissue dispensing container wherein the same includes adhesive strips for mounting of the container to a support, such as within a vehicle.

U.S. Pat. No. 3,151,793 to Smith provides a protective holder for dispensing wherein the same secures an elongate cylinder of sheet material and enables removal of such material from the container by an overlapping slot positioned medially of a wall of the container.

U.S. Pat. No. 3,667,596 to Lucas provides a sheet dispensing unit with a stack of sheet material adhesively fastened along one end to a rectangular header piece of a skirt depending along the periphery of the container to enable the sheets to be removed from the container on a selective basis.

As such, it may be appreciated that there is a continuing need for a new and improved bathroom tissue container which addresses both the problems of compactness of storage and effectiveness in use by maintaining a forward terminal end of the tissue in clamping alignment with an outlet of the container, and in this respect the present invention substantially fulfills this need.

SUMMARY OF THE INVENTION

In view of the foregoing disadvantages inherent in the known types of bathroom tissue containers now present in the prior art, the present invention provides a bathroom tissue container wherein the same includes compact storage of a cylindrical magazine of tissue with a central tubular core for securement within a dispensing container that enables convenient withdrawal of the tissue, as desired. As such, the general purpose of the present invention, which will be described subsequently in greater detail, is to provide a new and improved bathroom tissue container which has all the advantages of the prior art bathroom tissue containers and none of the disadvantages.

To attain this, the present invention comprises a bathroom tissue container wherein the same includes a magazine of a cylindrical supply of bathroom tissue with a conventional tubular core for receiving a support rod therethrough of a tubular support member of the container. The container includes an overlying threaded closure cap with a first layer of resilient cushioning with a contact disk laminated to the cushion for resilient securement of the magazine of tissue within the container, as well as providing a smooth contact surface for enabling rotation of the tissue magazine within the container. A first serrated clamp is secured coextensively with an elongate slot formed coaxially through a wall of the container, with a spaced second clamp spaced a distance from the first clamp to slidingly compress the tissue therebetween. The second clamp includes an integral cylindrical guide roll resiliently receivable within a semi-cylindrical groove formed within an interior wall of the container adjacent the elongate slot to maintain a smooth delivery of tissue from interiorly to exteriorly of the container. Alternatively, an interfolded magazine supply of tissue may be provided within a container of rectangular parallelepiped configuration provided with an elongate slot wherein said elongate slot is provided with a similar first fixed and second movable clamp to secure the tissue therebetween. A further embodiment includes a first tubular support to receive a second overlying tubular support. A central tubular rod extends upwardly and from the interior of the first tubular support and is received within a second hollow tubular rod to align the tubular rod relative to the upper and lower container portions.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form &he subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims nor is it intended to be limiting as to the scope of the invention in any way.

It is therefore an object of the present invention to provide a new and improved bathroom tissue container which has all the advantages of the prior art bathroom tissue containers and none of the disadvantages.

It is another object of the present invention to provide a new and improved bathroom tissue container which may be easily and efficiently manufactured and marketed.

It is a further object of the present invention to provide a new and improved bathroom tissue container which is of a durable and reliable construction.

An even further object of the present invention is to provide a new and improved bathroom tissue container which is susceptible of a low cost of manufacture with regard to both materials and labor, and which accordingly is then susceptible of low prices of sale to the consuming public, thereby making such bathroom tissue container economically available to the buying public.

Still yet another object of the present invention is to provide a new and improved bathroom tissue container which provides in the apparatuses and methods of the prior art some of the advantages thereof, while simultaneously overcoming some of the disadvantages normally associated therewith.

Still another object of the present invention is to provide a new and improved bathroom tissue container wherein the same provides magazine storage and selective removal of bathroom tissue from interiorly of the container including clamping members to maintain the tissue from withdrawal into the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
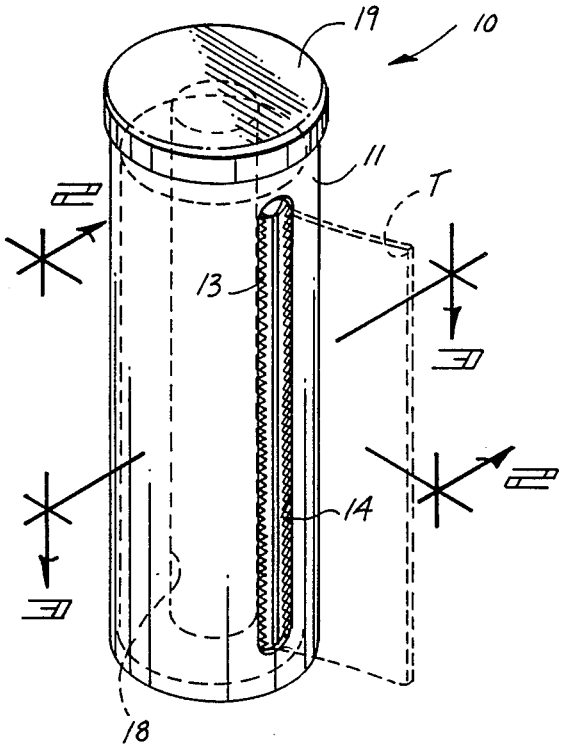
FIG. 1 is an isometric illustration of the instant invention.
Figure 2:
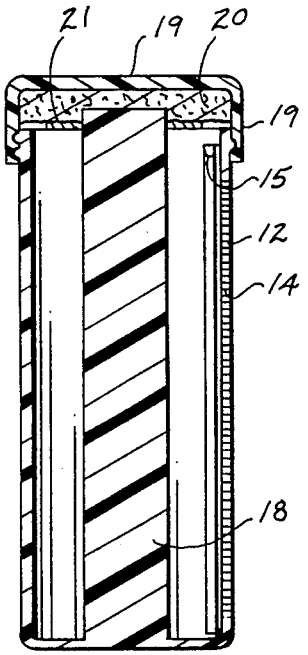
FIG. 2 is an orthographic cross-sectional view taken along the section lines 2—2 of FIG. 1 in the direction indicated by the arrows.
Figure 3:
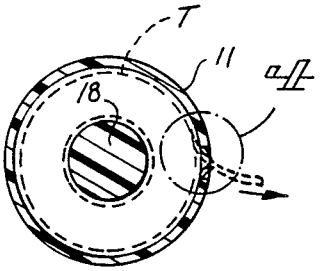
FIG. 3 is an orthographic cross-sectional view taken along the lines 3—3 of FIG. 1 in the direction indicated by the arrows.

With reference now to the drawings, and in particular to FIGS. 1 to 6 thereof a new and improved bathroom tissue container embodying the principles and concepts of the present invention and generally designated by the reference numeral 10 will be described.

Figure 4:
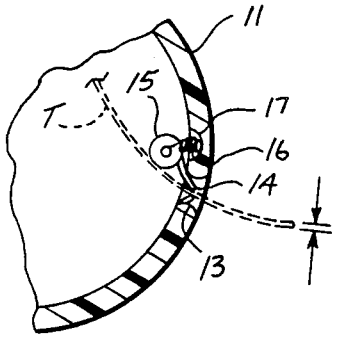
FIG. 4 is an enlarged sectional view of section 4 as set forth in FIG. 3.

More specifically, the bathroom tissue container apparatus 10 includes an elongate tubular support member 11 provided with an interior volume to contain a cylindrical roll of tissue "T" provided with a hollow central core, as is conventional in the production of bathroom tissue. The container includes an elongate slot 12 formed coaxially with the support member 11 to a vertical wall of the support member with each longitudinal confronting surface of the slot including a clamp structure. The clamp structure includes a first fixed serrated clamp 13, as illustrated in FIG. 4 for example, spaced from a second movable serrated clamp 14. The movable serrated clamp 14 is integrally formed to a cylindrical guide roll 15 wherein the guide roll 15 includes an internal cavity to receive a spring 16 to normally bias the guide roll 15 exteriorly of a semi-cylindrical recess 17. The semi-cylindrical recess 17 is of a configuration complementary to that of the guide roll 15 to receive approximately half of the guide roll therein to maintain a semi-cylindrical exterior guide roll at all times extending above an interior wall of the support member to provide a guide surface for the tissue "T" traversing thereby.

It should be noted, as per the illustration in FIG. 4, that the respective first and second serrated clamps 13 and 14 are positioned and maintained below an exterior surface of the cylindrical wall defined by the support member 11 to prevent inadvertent injury to an individual utilizing the apparatus. Further, the first serrated clamp 13 is angulated towards the confronting serrated edge of the slot 12 with the second movable serrated clamp 14 angulated forward the opposing confronting slot to provide a pinching of the tissue therebetween.

A central cylindrical support post 18 is coaxially formed with the tubular support member 11 and extends coextensively thereof and above an upper terminal end of the support member 11. A closure cap 19 is threadedly engageable to the upper terminal end of the support member 11 and includes a resilient cushion 20 laminated therewithin with a smooth polymeric abutment disk 21 laminated to the cushion. The disk 21 includes a central aperture of a diameter substantially equal to that of the support post 18 to slidingly and guidingly receive the support post therethrough to enable its confrontation and compaction of the resilient cushion 20 in confronting relationship with the post to effect rigidity and geometric integrity of the container when thusly assembled.

Figure 5:
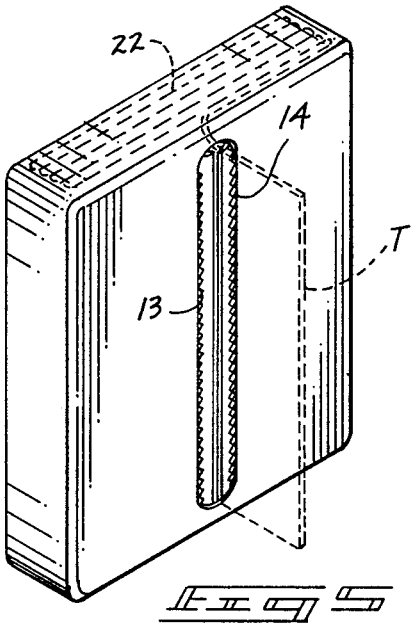
FIG. 5 is an isometric illustration of a further embodiment of the instant invention.

FIG. 5 is illustrative of an embodiment of the invention utilizing layered bathroom tissue 22 secured within a container of rectangular parallelepiped construction. The container includes an elongate slot of construction, as illustrated and presented within FIGS. 1 through 4.

Figure 6:
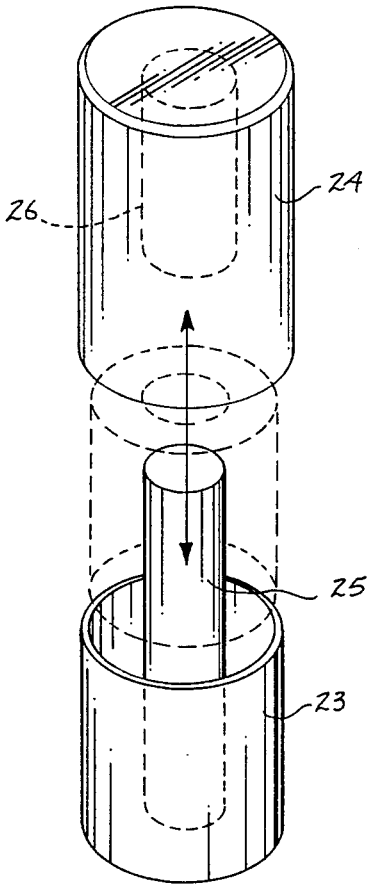
FIG. 6 is an isometric illustration of a still further embodiment of the instant invention.

FIG. 6 sets forth a further embodiment of the instant invention wherein a first cylindrical container of solid wall construction slidingly receives thereover a second cylindrical container 24. The first cylindrical container 23 includes a first container support rod 25 of a length substantially equal to the axial length of the first container 23 and the second container 24. An upper terminal end of the first container support rod 25 is receivable within a second hollow support rod 26 axially aligned with and secured to the second cylindrical container 24 to maintain a roll of tissue "T" therein.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bathroom tissue container for securement of a roll of tissue of a predetermined height therein, said roll of tissue including a continuously wound sheet of perforated tissue of a predetermined thickness wound about a central hollow core, said container comprising, an elongate tubular support member including a floor and a cylindrical wall with a support rod fixedly mounted to the floor and extending medially and axially from the floor to a position above an upper terminal end of the cylindrical wall, and a closure cap threadedly securable to the upper terminal end of the cylindrical wall, and a slot formed to the cylindrical wall parallel to the support rod, and clamp means cooperative with the slot to secure the terminal end of the sheet of tissue therebetween and prevent the tissue from re-entry into the tubular support member, and wherein the closure cap includes a resilient cushion laminated to an interior surface of the cap, and the resilient cushion including a smooth polymeric abutment disk laminated thereto coaxially of the cap, the disk includes a central aperture of a diameter substantially equal to the diameter of the support rod to receive the support rod therethrough.

2. A bathroom tissue container as set forth in claim 1 wherein the clamping means includes a first clamp fixedly secured to an elongate first edge of the slot, the first clamp defined by a serrated clamp member angulated towards a second elongate edge of the slot.

3. A bathroom tissue container as set forth in claim 2 wherein the clamp means further includes a second movable clamp mounted adjacent the second edge of the slot cooperative with the first serrated clamp member, the second clamp including an elongate serrated clamp member fixedly mounted to a elongate cylindrical guide roll positioned interiorly of the container.

4. A bathroom tissue container as set forth in claim 3 wherein the elongate cylindrical guide roll includes an internal cavity with a spring mounted therein and extending exteriorly through a rear surface of the cylindrical guide roll, and the guide roll receivable within a semi-cylindrical groove.

5. A bathroom tissue container as set forth in claim 4 wherein the semi-cylindrical groove is of a complementary configuration to the guide roll and is of a depth substantially equal to half of a diameter defined by that of the guide roll to maintain the guide roll above an interior surface of the cylindrical wall.

6. A bathroom tissue container as set forth in claim 5 wherein the first and second clamps define a thickness spacing therebetween less than that defined by the predetermined thickness of the perforated tissue to effect a pinching of the tissue between the first and second clamps.

* * * * *